US005887556A

United States Patent [19]

Kim

[11] Patent Number: 5,887,556

[45] Date of Patent: Mar. 30, 1999

[54] DEVICE FOR FORMING VORTEX IN COOLING WATER FOR CYLINDERS

[75] Inventor: Gyu Wan Kim, Seoul, Rep. of Korea

[73] Assignee: Hyundai Motor Company, Seoul, Rep. of Korea

[21] Appl. No.: 946,229

[22] Filed: Oct. 7, 1997

[51] Int. Cl.[6] ..... F02F 1/14

[52] U.S. Cl. ..... 123/41.79; 123/41.82 R; 123/41.72

[58] Field of Search ..... 123/41.82, 41.79, 123/41.72

*Primary Examiner*—Noah P. Kamen
*Assistant Examiner*—Jason Benton
*Attorney, Agent, or Firm*—Christie, Parker & Hale, LLP

[57] ABSTRACT

A device for generating vortex in cooling water for cylinders of internal combustion engines is disclosed. In the device, a steel casing is inserted into the bottom portion of a cooling water passage of a cylinder head. The steel casing is comprised of inner and outer rings, with an annular cavity being formed between the two rings and allowing engine oil to pass through. A plurality of pressure units are radially mounted to the inner ring. Each of the pressure units is radially movable in opposite directions in response to the pressure of the engine oil in the annular cavity, thus forming vortex in the cooling water passing through the inner ring. The device of this invention enlarges the cooling water contact area of the cylinder, thereby improving the cylinder cooling effect and increasing the engine output power.

3 Claims, 3 Drawing Sheets

【FIG.1】
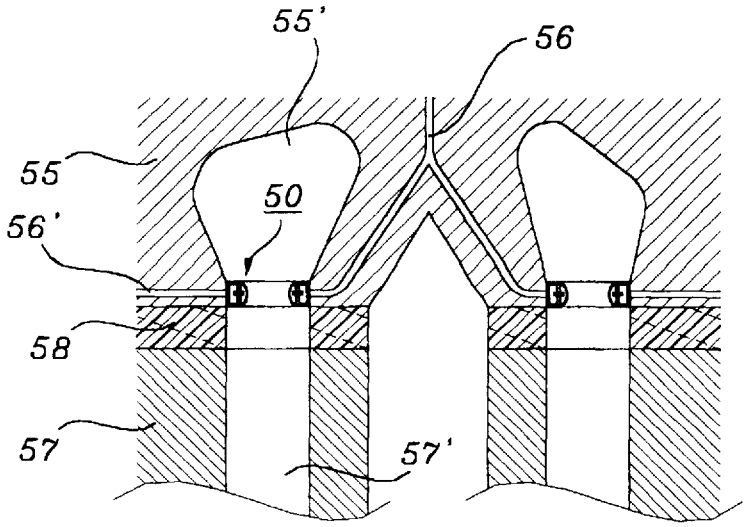
【FIG.2A】
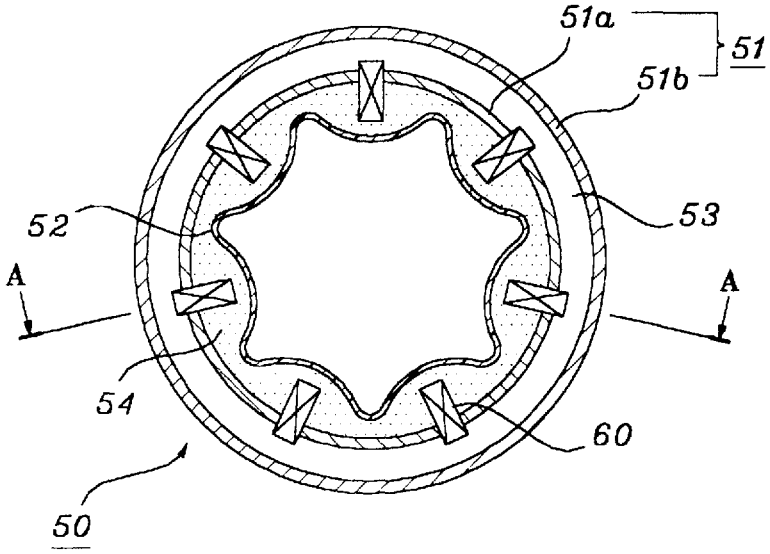

【FIG.2B】
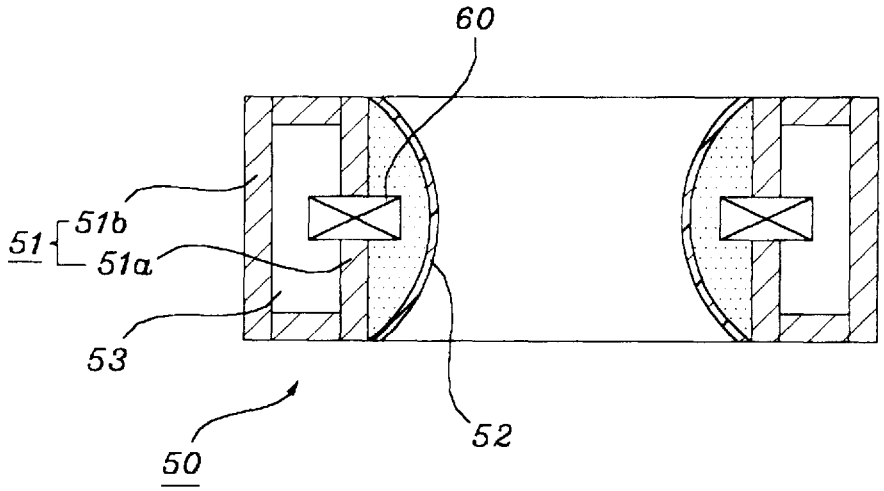
【FIG.3】
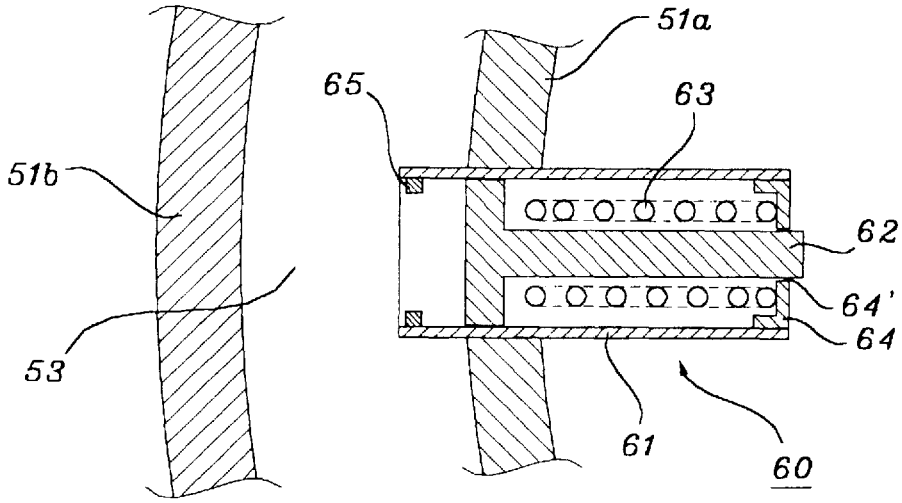

【FIG.4 (Prior Art)】
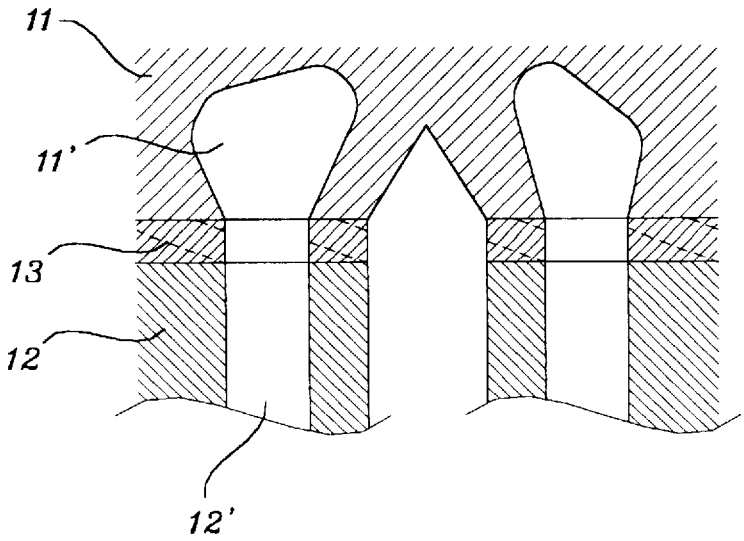

DEVICE FOR FORMING VORTEX IN COOLING WATER FOR CYLINDERS

BACKGROUND OF THE INVENTION

1. Field of the Invention

The present invention relates, in general, to a water system for cooling cylinders of internal combustion engines and, more particularly, to a device for generating vortex in cooling water flowing through the water passages of a cylinder, thus enlarging the cooling water contact area of the cylinder and improving the cylinder cooling effect and increasing the engine output power.

2. Description of the Prior Art

FIG. 4 is a sectional view showing the construction of a typical water system for cooling a cylinder of an internal combustion engine. As shown in the drawing, the typical water system for cooling cylinders is comprised of two cooling water passages, that is, a first passage 11' formed in a cylinder head 11 and a second passage 12' formed in a cylinder block 12. The system also includes a gasket 13, which is positioned at the junction between the cylinder head 11 and the cylinder block 12, with a plurality of communication holes being formed on the gasket 13 and allowing the two passages 11' and 12' to communicate with each other therethrough.

In the operation of the above system, cooling water passes from the first passage 11' of the cylinder head 11 into the second passage 12' of the cylinder block 12 through the communication holes of the gasket 13. When the cooling water passes through the two passages 11' and 12' , it cools both the combustion chamber and the cylinder, thus increasing the output power of an engine.

However, the typical system has the following problem. That is, since the cooling water in such a system only forms a parallel flow while the water flows from the first passage 11' into the second passage 12', the cooling water contact area of the cylinder is regrettably limited, thus reducing the cylinder cooling effect.

SUMMARY OF THE INVENTION

Accordingly, the present invention has been made keeping in mind the above problems occurring in the prior art, and an object of the present invention is to provide a device for generating vortex in cooling water flowing through the water passages of a cylinder, thus enlarging the cooling water contact area of the cylinder and improving the cylinder cooling effect and increasing the engine output power.

In order to accomplish the above object, the present invention provides a device for generating vortex in cooling water for cylinders, comprising: a steel casing inserted in the bottom portion of a cooling water passage of a cylinder head, the steel casing being comprised of inner and outer rings with an annular cavity being formed between the two rings, and a plurality of pressure units radially mounted to the inner ring, each of the pressure units being radially movable in opposite directions by the pressure of engine oil flowing in the annular cavity between the two rings, thus forming vortex in the cooling water passing through the inner ring.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sectional view showing the construction of a device for forming vortex in cooling water for cylinders in accordance with the preferred embodiment of the present invention;

FIGS. 2A and 2B are sectional views of the vortex forming device of this invention, respectively, in which:

FIG. 2A is a cross-sectioned view of the vortex forming device; and

FIG. 2B is a longitudinal-sectioned view of the vortex forming device;

FIG. 3 is an enlarged sectional view of a spring-biased pressure unit, which is provided on the vortex forming device of this invention and is used for selectively forming vortex in cooling water in response to the pressure of engine oil; and FIG. 4 is a sectional view showing the construction of a typical water system for cooling cylinders of an internal combustion engine.

DESCRIPTION OF THE PREFERRED EMBODIMENTS

FIGS. 1, 2A and 2B show the construction of a device for forming vortex in cooling water for cylinders in accordance with the preferred embodiment of the invention. As shown in the drawings, the vortex forming device 50 includes a steel casing 51, which is inserted in the bottom portion of each of the cooling water passages 55' of a cylinder head 55 and is comprised of two concentric rings, that is, inner and outer rings 51*a* and 51*b*. The vortex forming device 50 also includes a plurality of spring-biased pressure units 60, each of which is radially mounted to the inner ring 51*a*. The pressure units 60 are selectively operated by the pressure of engine oil flowing in the annular passage between the two rings 51*a* and 51*b*, thus forming vortex in cooling water flowing through the cooling water passage inside the inner ring 51*a*.

The top and bottom ends of the annular passage formed between the two rings 51*a* and 51*b* are closed, thus forming an annular cavity 53 which allows the engine oil to pass through the casing 51.

The regularly-spaced pressure units 60 are directed to the center of the two rings 51*a* and 51*b*, with both the inside end of each unit 60 being projected into the inner ring 51*a* and the outside end of each unit 60 being projected into the annular cavity 53 between the two rings 51*a* and 51*b*. A variable shielding membrane 52 is attached to the interior wall of the inner ring 51*a*, thus covering the interior wall of the ring 51*a* with wax 54 being filled in the cavity formed between the membrane 52 and the inner ring 51*a*. In order to feed the engine oil into the annular cavity 53 between the two rings 51*a* and 51*b*, the cylinder head 55 is provided with a plurality of oil passages 56 and 56'.

As shown in FIG. 3, each of the pressure units 60 is comprised of a cylindrical case 61, which is fixedly and radially mounted to the inner ring 51*a* with the inside end of each unit 60 being projected into the inner ring 51*a*. A spring-biased plunger 62 is axially and movably received in the case 61, with both the inside end of the plunger 62 being movable into the wax 54 and the outside end of the plunger 62 being pressurized by the engine oil in the annular cavity 53. A return spring 63 is received in the case 61 so as to normally bias the plunger 62 to the outer ring 51*b*. The inside end of the case 62 is closed by a spring seat 64, which stops the inside end of the spring 63 and has a center hole 64' for allowing the inside end of the plunger 62 to pass through. Fitted into the outside end of the case 62 is an annular stopper 65, which prevents an unexpected separation of the plunger 62 from the case 62. The outside end of the case 62 communicates with the annular cavity 53, thus allowing the pressure of the engine oil to act on the outside end of the plunger 62.

The operational effect of the above device will be described hereinbelow.

In the operation of the device, cooling water flows from the cooling water passage 55' of the cylinder head 55 into the cooling water passage 57' of the cylinder block 57 through the communication holes of the gasket 58.

On the other hand, engine oil is fed into the annular cavity 53 between the two rings 51*a* and 51*b* through the oil passage 56. In such a case, the pressure of the engine oil in the cavity 53 is increased in proportion to rpm (revolutions per minute) of an engine. Therefore, the spring-biased plunger 62 of each pressure unit 60 radially moves to the inside or outside in accordance with the difference between the engine oil pressure and the restoring force of the spring 63. Due to such a radial movement of the plungers 62, the inside sectional area of the inner ring 51*a* is repeatedly changed, thus forming vortex in the cooling water passing through the inner ring 51*a*. Particularly in the event of highly pressurized engine oil, the plungers 62 pressurize the wax 54, thus deforming the configuration of the membrane 52 and effectively promoting the formation of vortex in the cooling water.

When the temperature of the cooling water is increased, the wax 54 is completely liquidized, thus being expandable to the outside. However, such a liquidized and expandable wax 54 fails to uniformly expand due to the pressure units 60, thus effectively forming vortex in the cooling water.

When vortex is formed in the cooling water as described above, the cooling water is brought into uniform contact with the cylinder, thus improving the cylinder cooling effect and increasing the engine output power.

As described above, the present invention provides a device for generating vortex in cooling water for cylinders of internal combustion engines. The device of this invention selectively forms vortex in the cooling water in response to the variable pressure of engine oil, thus allowing the cooling water to come into uniform contact with the cylinders. Therefore, the vortex forming device improves the cylinder cooling effect and increases the engine output power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for generating vortex in cooling water for cylinders, comprising:

a steel casing inserted in the bottom portion of a cooling water passage of a cylinder head, said steel casing being comprised of inner and outer rings with an annular cavity being formed between the two rings; and a plurality of pressure units radially mounted to said inner ring, each of said pressure units being radially movable in opposite directions by the pressure of engine oil flowing in the annular cavity between the two rings, thus forming vortex in the cooling water passing through the inner ring.

2. The device according to claim 1, further comprising:

a variable membrane attached to the interior wall of said inner ring, thus covering said interior wall of the inner ring with wax being filled between the membrane and the inner ring.

3. The device according to claim 1, wherein each of said pressure units comprises:

a cylindrical case radially set on the inner ring, with one end of said case being projected into the annular cavity and the other end being projected into the inner ring;

a plunger received in said case, said plunger being radially movable in opposite directions in response to the pressure of the engine oil;

a return spring normally biasing said plunger into the annular cavity;

a spring seat provided on the inside end of said case and adapted for holding the return spring, said spring seat also having a hole for allowing the inside end of the plunger to pass through; and a stopper provided on the outside end of said case and adapted for preventing an unexpected separation of the plunger from said case.

* * * * *